United States Patent [19]

Dill

[11] 4,070,791

[45] Jan. 31, 1978

[54] WHEEL TOY

[76] Inventor: J. D. Franklin Dill, Rte. 6, Box 37, Jasper, Ala. 35501

[21] Appl. No.: 715,555

[22] Filed: Aug. 18, 1976

[51] Int. Cl.[2] ..... A63H 33/02

[52] U.S. Cl. ..... 46/220

[58] Field of Search ..... 46/114, 220, 205, 112

[56] References Cited

U.S. PATENT DOCUMENTS

| | | | |
|---|---|---|---|
| 1,216,589 | 2/1917 | Meyner | 46/220 |
| 1,376,601 | 5/1921 | Burrmann | 46/220 |
| 1,872,339 | 8/1932 | Putman | 46/220 |
| 3,892,084 | 7/1975 | Hanysz | 46/114 |

*Primary Examiner*—Louis G. Mancene

*Assistant Examiner*—Mickey Yu

*Attorney, Agent, or Firm*—Stevens, Davis, Miller & Mosher

[57] ABSTRACT

A push or pull toy comprising a hollow cylinder, two circular discs mounted on either end of said cylinder, said cylinder having a plurality of equally spaced hemicylindrical grooves in the outer periphery thereof, a roller bearing seated within each groove, a tire concentrically positioned outside of said cylinder, the tire having an inner peripheral groove to form a race for said bearings, a cylinder fitting between said discs inside said hollow cylinder and having an axial hole therein and a rod having one end thereof freely fitted into said axial hole, said cylinder having said axial hole being eccentrically attached to said discs.

2 Claims, 2 Drawing Figures

WHEEL TOY

This invention relates to a push or pull toy in the form of a wheel having a large non-rotatable central section. More particularly, the invention relates to a wheel toy having a rotatable outer section, a non-rotatable central section and a push rod attached to the central section.

Push or pull toys in the form of wheels have in the past been designed to have the central section rotate. However, this has precluded placing decals carrying wording or designs which must remain upright on the central section if it is intended to have the wording read or the design understood while the toy was being pushed or pulled.

It is therefore an object of the present invention to provide a push or pull toy in the form of a wheel upon which decals or designs may be placed which remain in the upright position.

According to the invention the wheel toy is composed of a central section to which is attached a push rod and about which is placed a tire rotatable about said central section.

This invention will now be described in more detail by reference to the attached drawing given by way of non-limiting example in which.

Figure 1:
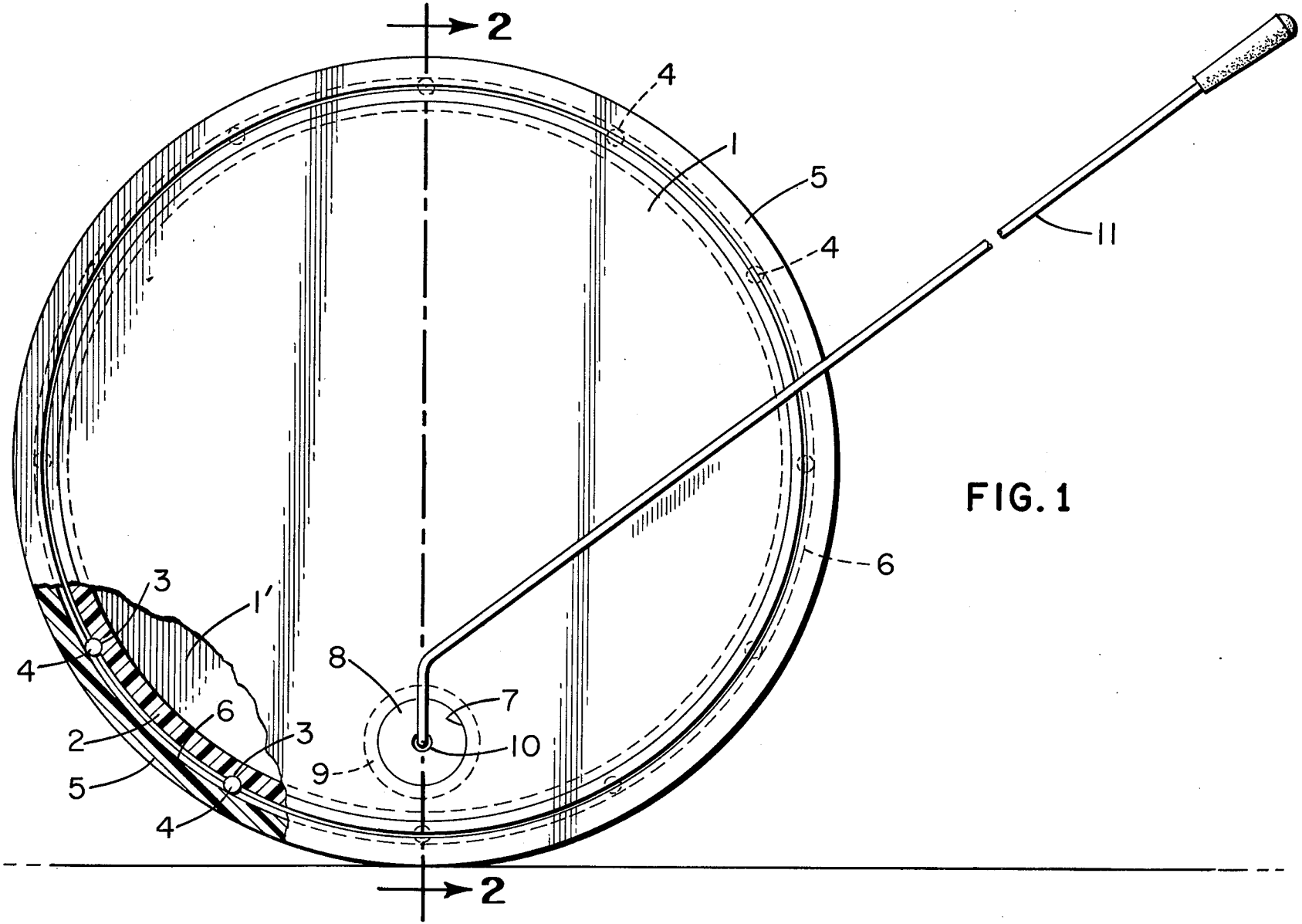
FIG. 1 is a side elevation of the invention.
Figure 2:
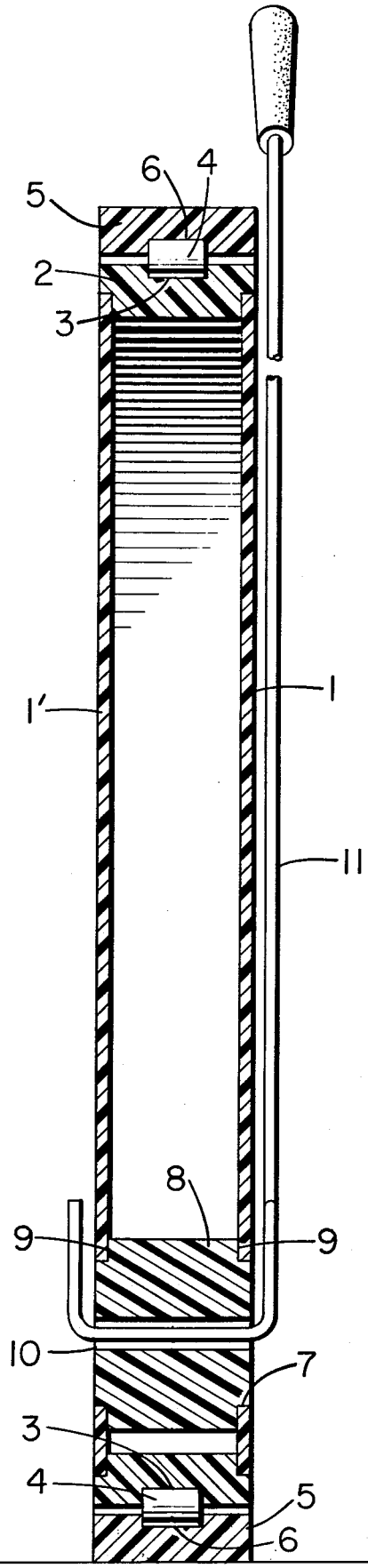
FIG. 2 is a section view of the invention taken through line II—II of FIG. 1.

Referring now to FIGS. 1 and 2, two discs 1, 1′ are attached to hollow cylinder 2. Equally spaced about the periphery of cylinder 2 are a plurality of hemi-cylindrical grooves 3 into each one of which is placed a roller bearing 4.

Concentrically arranged with and positioned radially outward of cylinder 2 is a tire 5. Tire 5 has an interior circumferential groove 6 which forms a race for roller bearings 4, enabling tire 5 to rotate and be maintained on cylinder 2.

Eccentrially positioned on discs 1, 1′ are holes 7, 7′ into which is fitted a cylinder 8 having peripheral grooves 9 on each end. Cylinder 8 has an axial hole 10 extending therethrough through which passes one end of a rod 11. Rod 11 has a U-shaped configuration on one end to enable it to be maintained in hole 10 while pushing or pulling the wheel.

By means of the foregoing arrangement tire 5 rotates when in contact with a surface and upon being pulled or pushed by rod 11 while discs 1, 1′ remain substantially stationary thus permitting wording to be read or designs to be understood on discs 1, 1′.

The toy may be made out of a number of materials such as wood, plastic, rubber or metal. The material of which each part is made will depend to a high degree on cost and function.

Although the invention has been herein shown and described in what is considered to be the most practical and preferred embodiment, it is recognized that departures may be made therefrom within the scope of the invention which is not to be limited to the details disclosed herein but is to be accorded the full scope of the claims so as to embrace any and all equivalent embodiments.

What is claimed is:

1. A push or pull toy consisting of a hollow cylinder, two circular discs mounted on either end of said cylinder, said cylinder having a plurality of equally spaced hemi-cylindrical grooves in the outer periphery thereof, a roller bearing seated within each groove, a tire concentrically positioned outside of said cylinder, said tire having an inner peripheral groove to form a race for said bearings and being spaced from said cylinder a distance equal to the diameter of the roller bearings minus the depth of the grooves and means to push or pull said toy eccentrically attached to said discs.

2. The push or pull toy of claim 1, wherein said means comprise a cylinder eccentrically fitting between said discs inside said hollow cylinder and having an axial hole therein and a rod having one end thereof freely fitted into said axial hole.

* * * * *